US007204693B2

(12) United States Patent
Nagle

(10) Patent No.: US 7,204,693 B2
(45) Date of Patent: Apr. 17, 2007

(54) EGYPTIAN PYRAMIDS BOARD GAME

(76) Inventor: George L. Nagle, 66 Sky Manor Rd., Pittstown, NJ (US) 08867

( * ) Notice: Subject to any disclaimer, the term of this patent is extended or adjusted under 35 U.S.C. 154(b) by 0 days.

(21) Appl. No.: 10/807,855

(22) Filed: Mar. 24, 2004

(65) Prior Publication Data

US 2005/0212208 A1 Sep. 29, 2005

(51) Int. Cl.
*G09B 19/22* (2006.01)

(52) U.S. Cl. ..... 434/128; 273/256; 273/278

(58) Field of Classification Search ..... 434/128, 434/129; 273/256, 278
See application file for complete search history.

(56) References Cited

U.S. PATENT DOCUMENTS 2,026,082 A * 12/1935 Darrow ..... 273/256
4,093,235 A 6/1978 Barry
4,140,319 A 2/1979 Aycock et al.
4,162,073 A * 7/1979 Norris ..... 273/144 B
4,283,059 A * 8/1981 Beeder ..... 273/254
4,522,407 A 6/1985 Hatherley
4,824,117 A 4/1989 Russell
4,856,788 A 8/1989 Fischel
4,988,108 A * 1/1991 Shepard ..... 273/254
5,071,133 A * 12/1991 Smith ..... 273/248
5,087,051 A 2/1992 LoBue
5,292,133 A * 3/1994 Alexander ..... 273/256
5,478,086 A 12/1995 Aylett
5,810,359 A 9/1998 Wilkins et al.
6,352,259 B1 3/2002 Israel

* cited by examiner

*Primary Examiner*—Bena Miller
(74) *Attorney, Agent, or Firm*—Kenneth P. Glynn

(57) ABSTRACT

The game includes a playing board having a predetermined continuous path with spaces for movement of pieces therealong in accordance with rules. The playing board includes: (i) marked historical location spaces designating a specified historical location based on a predetermined theme, especially Egyptian pyramids, the spaces identifying its specified historical location by name, pictorial representation or combinations thereof, and having a specified cost to operate value and a landing fee value. (ii) marked action spaces, each designated so as to require a specified action of a player when a piece lands thereon; (iii) marked event spaces, which may initiate a payment or other event of a player when a piece lands thereon. Random movement is established with at least one die, which has six major facets, forming a cube, and eight minor facets. There is a set of operation papers, a set of event cards, a plurality of different icon pieces for use by a plurality of players, and a set of rules.

12 Claims, 7 Drawing Sheets

PLAYING BOARD

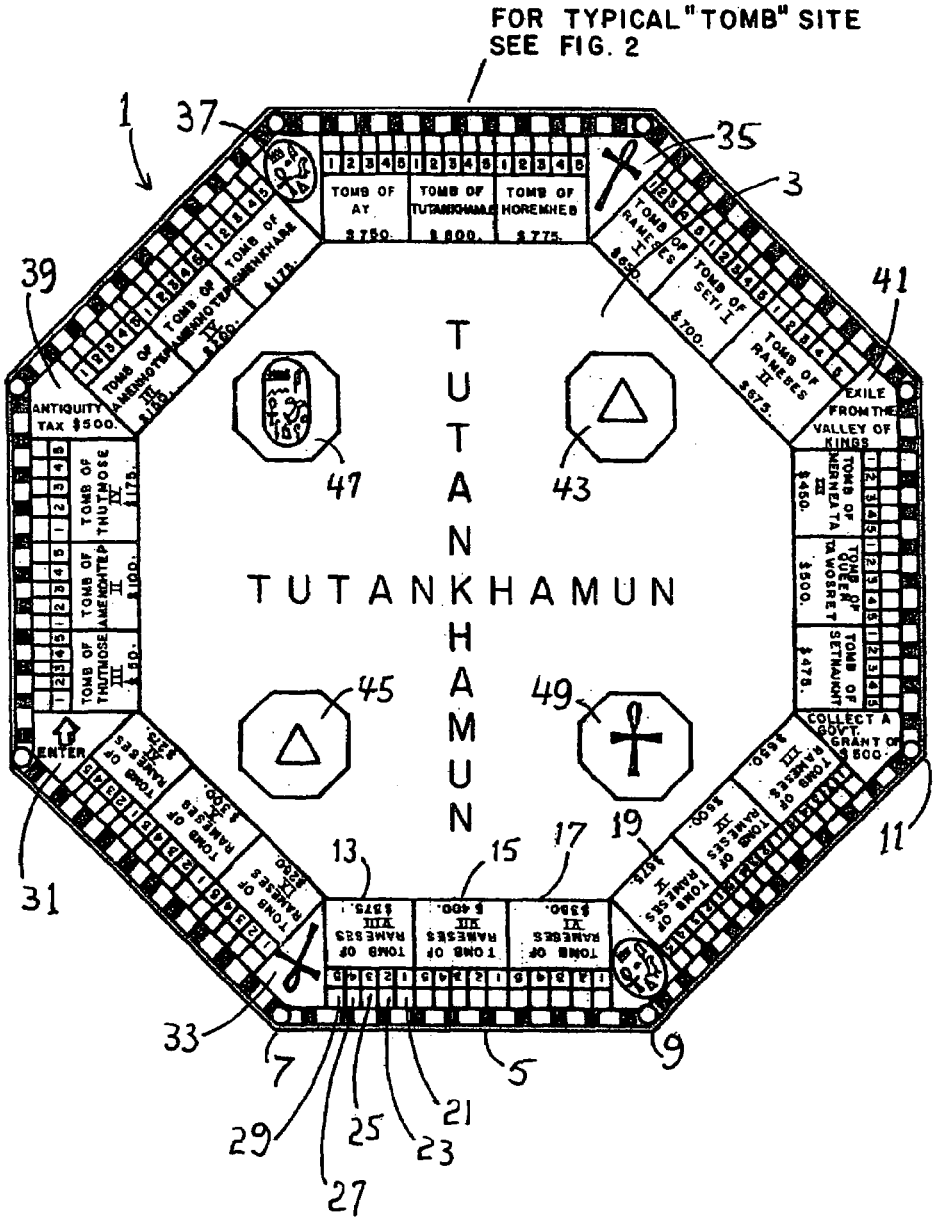
FIG. 1 PLAYING BOARD

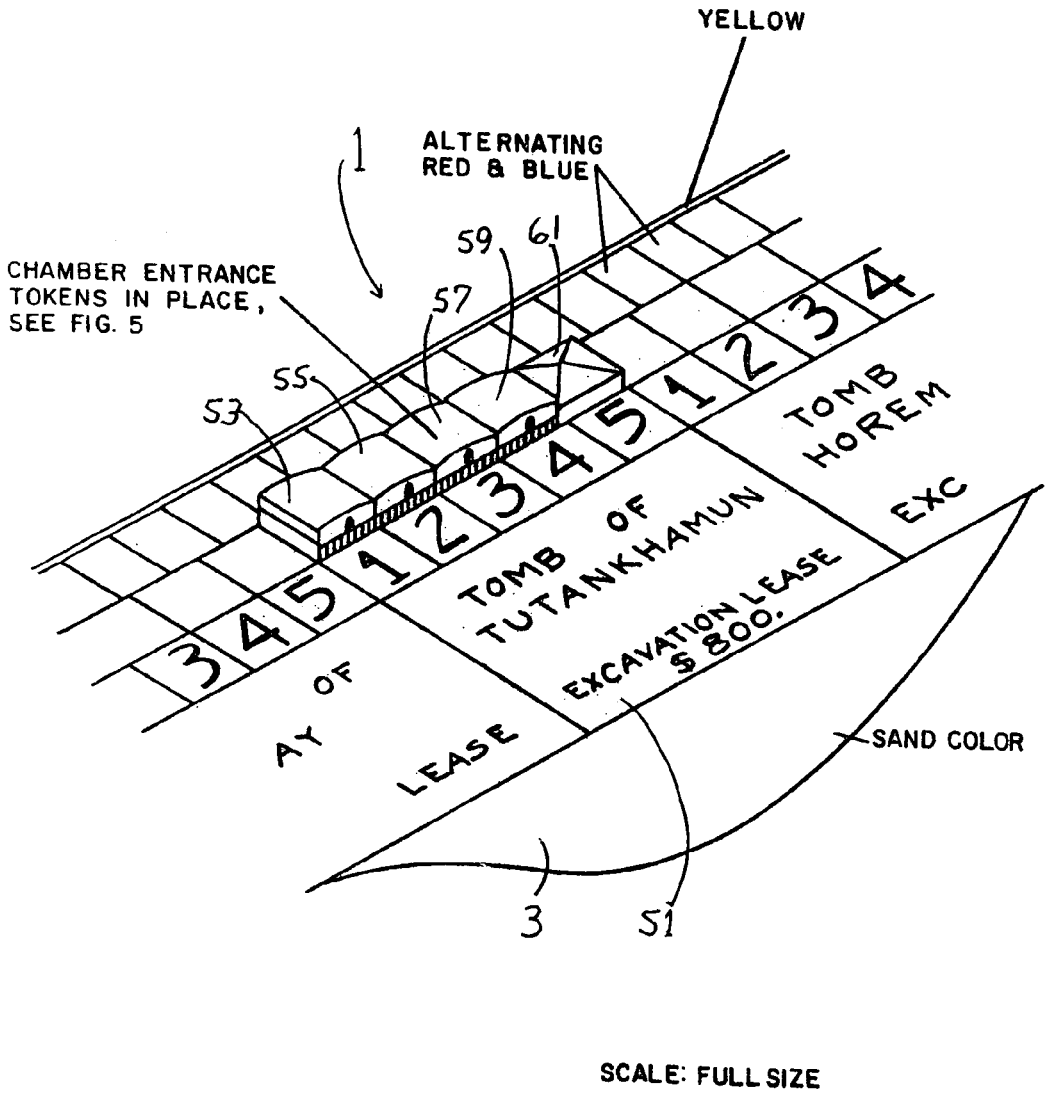
FIG. 2 TYPICAL "TOMB" SITE ON BOARD

(15) REQUIRED (6) REQUIRED

(15) REQUIRED (6) REQUIRED

SCALE: FULL SIZE

DRAW CARDS

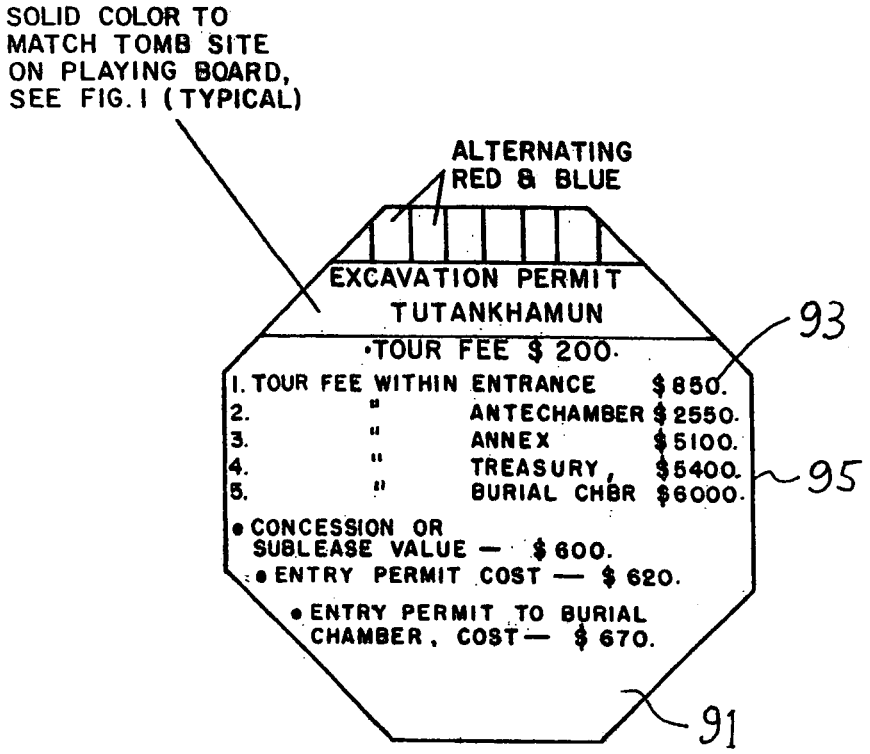
(24) REQUIRED
SCALE: FULL SIZE
FIG. 4 TYPICAL EXCAVATION PERMIT

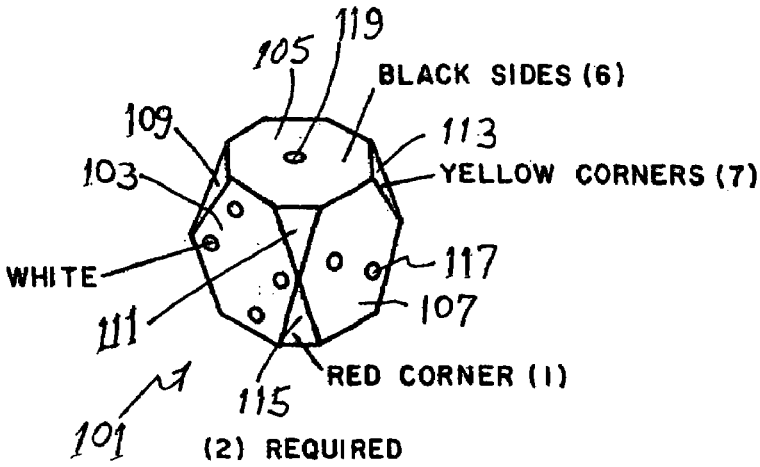
FIG. 5A
FIG. 5B
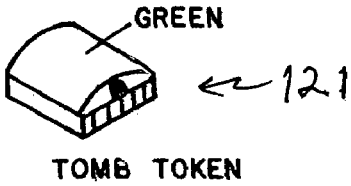
FIG. 5C
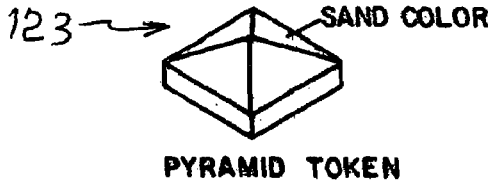
SPECIAL DICE & TOMB ENTRY TOKENS

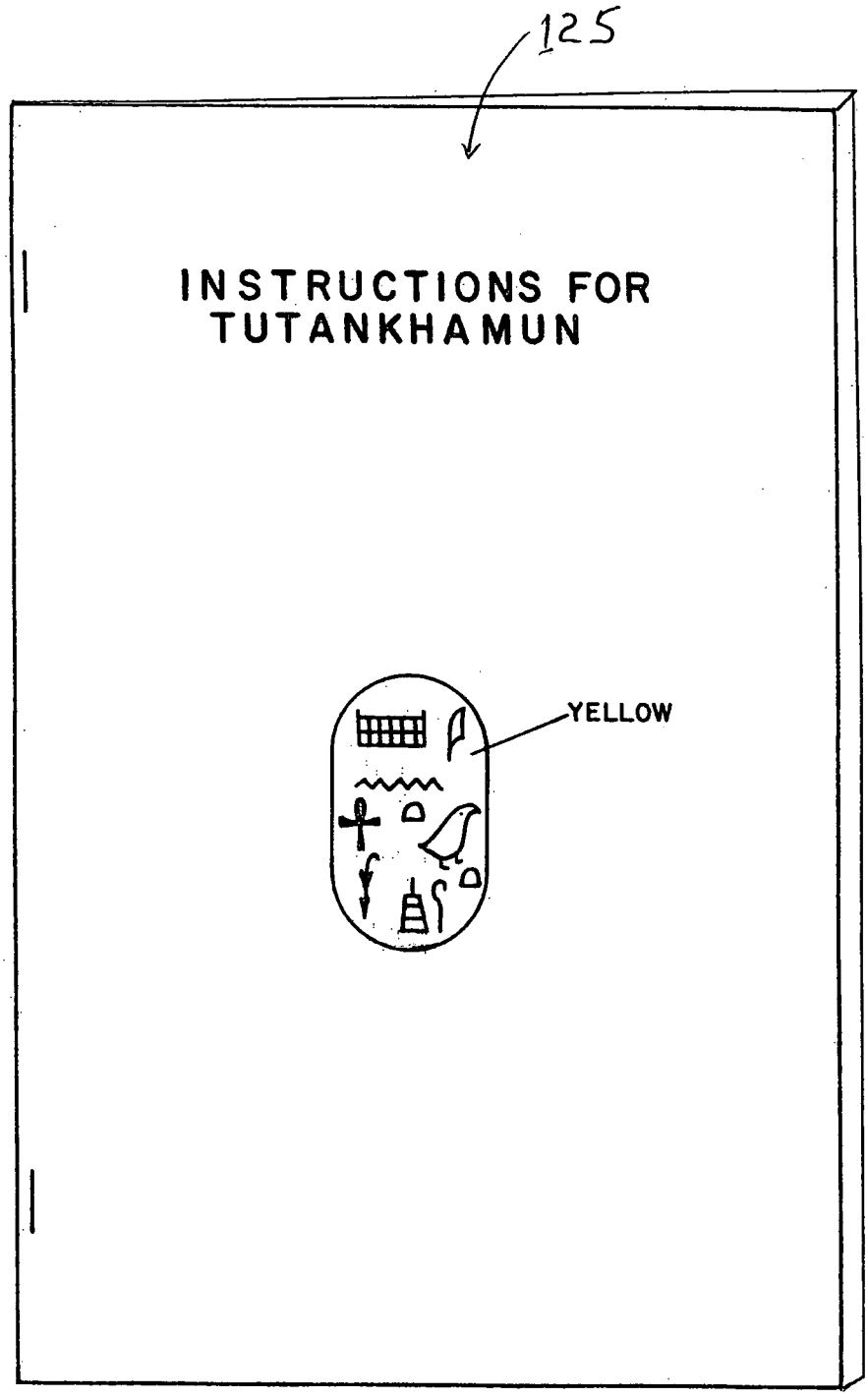
FIG. 6 INSTRUCTION BOOKLET COVER

FIG. 7A
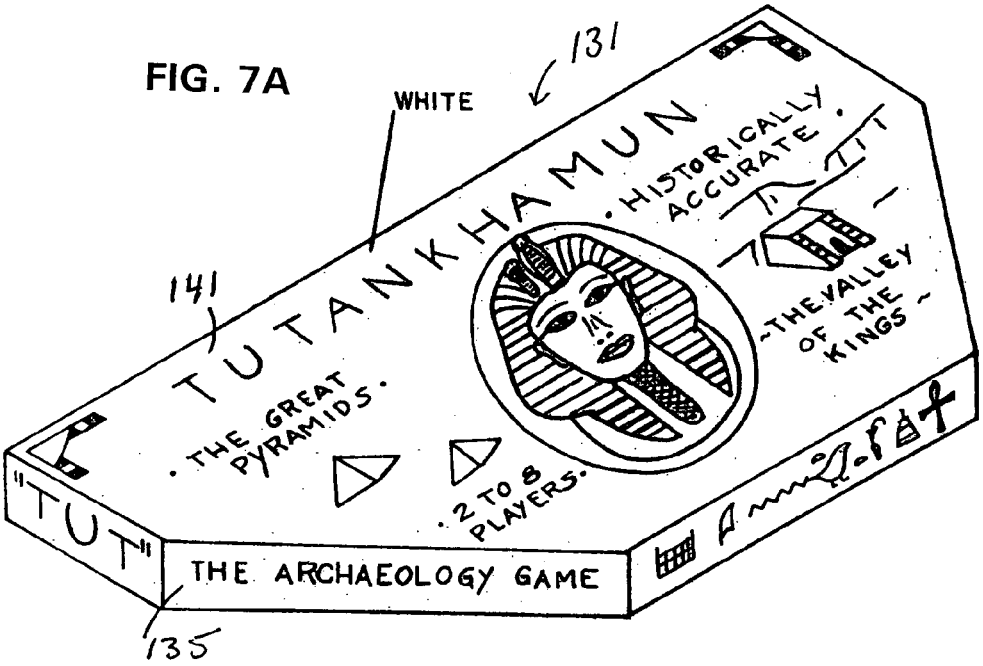
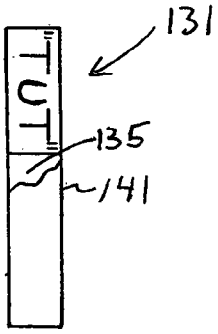
FIG. 7B
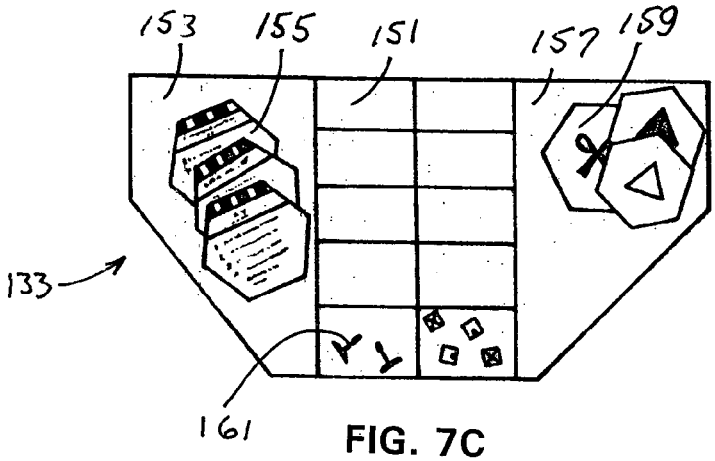
FIG. 7C
SCALE: 3" = 1'-0"

EGYPTIAN PYRAMIDS BOARD GAME

BACKGROUND OF THE INVENTION

1. Field of the Invention

The present invention relates to board games that are based in part on skill and in part on luck, and also perform the function of teaching. More specifically, the present invention relates game board that relate to history and/or geography and to the skills of fact learning, strategy, acquisitions, and chance. In its most preferred embodiments, the present invention game boards are Egyptian pyramid game boards with particular focus on King Tutankhamun, commonly known as King Tut.

2. Information Disclosure Statement

The following prior art is representative of the state of the art in the field of board games:

U.S. Pat. No. 2,026,082 issued to Charles E. Darrow describes a board game apparatus commonly known as "Monopoly", which involves the use of a game board, dice, moveable pieces, houses, hotels, deeds, chance cards, opportunity cards, play money and rules.

U.S. Pat. No. 4,093,235 describes a board game apparatus for educating players with respect to tourist attractions within a particular geographical region. The apparatus includes a board having a continuous path comprising areas representing particular localities within the geographical region and a series of cards having either questions concerning the various tourist attractions of the localities or other instructions. Another set of cards represent rewards obtained during the course of playing the game. Each of the areas representing the localities are appropriately marked to indicate whether the particular locality is accessible by boat and/or by airplane while all of the localities are accessible by car. A set of tokens are provided for each player, each set including an automobile token, a boat token and an airplane token, each respective token being permitted to occupy only those areas appropriately designated as being accessible by that particular instrumentality.

U.S. Pat. No. 4,140,319 describes a board game for a plurality of players including the following. A playing board has an endless course thereon for being progressively and periodically traversed in turn by each player during play of the game and comprises a plurality of serially connected playing spaces having indicia thereon for individually identifying respective spaces and the affect of game play upon a player occupying such spaces during traversing of the course. Certain of the contiguous spaces are designated by the indicia for defining distinguishable groups of predetermined numbers of the spaces and providing for the opportunity of acquisition of the spaces of the groups upon a player first occupying a respective one of the spaces of the groups for progressively accumulating all or part of the spaces of the respective groups for differently affecting game play upon another player subsequently occupying any one of the acquired spaces. A plurality of playing pieces is provided for individual use by the players in traversing the course on the board. A device is operable by the players in sequence for randomly determining the number of the spaces to be traversed per turn by the playing piece of each player. A plurality of transparent overlays are provided for respective acquisition by the players and for being placed over predetermined numbers of the spaces of the groups upon acquisition by the players and for being placed over predetermined number of the spaces of the groups upon acquisition of the spaces of the groups and the overlay for further differently affecting game play upon another player subsequently occupying any of the acquired spaces with the overlay thereon, while allowing visual observation of the indicia on the spaces through the transparent overlay thereon.

U.S. Pat. No. 4,522,407 describes a board game of the kind wherein players are represented by pieces movable on a board along a track of main stations. The number of stations is selected by chance prior to each piece's movement and each player may effect financial transactions, the nature of which transaction depends on the main station on which transaction depends on the main station on which each player's piece lands. The game includes two tracks of main stations, four transit stations enabling movement from one track to the other and a track of index stations along which an index token may move to modify the purchasing power of the currency by which the transactions are effected. One of the two main tracks has a higher proportion of a first type of main station and a lower proportion of a second type of main station than the other main track. Players elect a President who, subject to Congress, determines the tax rates and like matters. Players may buy, sell and rent property, raise loans, buy and sell bonds in simulation of economic competition in a free enterprise society.

U.S. Pat. No. 4,824,117 describes a board game in which one object is to acquire animal body parts. The game employs a game board, tokens and a set of "Hospital Cards" which designate various animal parts. A round of the game ends once a player completes an animal and has successfully moved his token to its corresponding "Home" space on the game board. After playing four rounds a "Winner Card" is picked which establishes the criteria for determining the winner.

U.S. Pat. No. 4,856,788 describes a board game apparatus for simulating situations of economics and finance includes: (a) a game board defining a multiplicity of contiguous closed track extending about the game board, each space playing position bearing indicia of instructions for play of the game; (b) a plurality of playing pieces representing each player; (c) die for determining how many space playing positions to move each playing piece; (d) simulated money of different denominations for use by the players of the game; (e) cards indicating ownership of assets for purchase and sale by players using the simulated money; and (f) cards on one face indicating an event having a potential economic effect on the game value of an asset held by a player, and, when turned over to the other face after the players have had an opportunity to act upon an expected economic effect of the event, revealing the actual game economic effect of the event. The indicia of instructions for play of the game on the game board includes one or more spaces instructing a player to consult the cards indicating an event having potential economic effect and includes one or more spaces permitting a player to buy and/or sell the cards indicating ownership of an asset. A method of playing the board game is also described.

U.S. Pat. No. 5,087,051 describes a quiz football board game having a continuous path around its perimeter divided into consecutive playing spaces bearing instructions representing various things to do during the play of the game and a plurality of simulated football playing fields with yardage markings thereon. A playing piece is for each of the game players with each playing piece representing a football team and being of a size to fit within the playing spaces. A change mechanism is operable by the players in sequence for determining the number of playing spaces to be traversed per turn by each playing piece. A football marker is for indicating the position and advancement of a football alone one of the simulated football playing fields. A down marker is to indicate the correct down for each player. A plurality of professional football question and answer cards, a plurality of college football question and answer cards, a plurality of offensive penalty cards and a plurality of defensive penalty cards are also provided.

U.S. Pat. No. 5,478,086 describes a theme park board game comprising: a game board formed in a planar configuration and including a plurality of structures simulating the star attractions, minor attractions, rides, vendor and food areas normally found in a theme park, the various structures being connected by a plurality of circles, the circles granting players various game related aids and obstacles; the game having a plurality of accessories including: human and animal characters, tokens having differing thickness' and point values imprinted thereupon, a score tallying device, a chance device, play money formed in a variety of different instructional indicia; and a set of playing rules informing the uses how to play a game, each player moving their chosen character the number of circles dictated by the chance device, the players being required to visit specified board structures, players accumulating token points as they traverse the circles and structures of the game, the player with the most token points at the end of the game being declared the winner.

U.S. Pat. No. 5,810,359 describes an add-on board game which permits transitions between new and existing boards based on random factors. The game includes a variety of new features including travel cards, random penalties and bonuses, and different mechanisms for traveling around the board. The add-on board game may be adapted for use with the MONOPOLY board game.

U.S. Pat. No. 6,352,259 B1 describes a pet lover's board game. It includes a playing board having a predetermined continuous path with spaces for movement of pieces therealong in accordance with rules. The playing board has marked breed spaces designated a specified breed of animal selected from cats, dogs, birds, horses and combinations thereof which have specified cost to own and a landing fee value. The board also has marked action spaces and marked event spaces. There is a random movement mechanism for randomly determining numbers of spaces to be moved by players in accordance with the rules, a set of pet ownership papers for the marked breed spaces provided to a player in exchange for payment of play money, and a set of event cards. Play money is used to make purchases, pay fines and pay landing fees. In preferred embodiments, houses and maro-houses may be purchased to enhance values and increase landing fees.

Notwithstanding the prior art, the present invention is neither taught nor rendered obvious thereby.

SUMMARY OF THE INVENTION

The present invention relates to a board game that is used to teach, as well as provide players enjoyment. In its broad sense, the game includes a playing board having a predetermined continuous path with spaces for movement of pieces therealong in accordance with rules. The playing board includes: (i) marked historical location spaces designating a specified historical location based on a predetermined theme, the spaces identifying its specified historical location by name, pictorial representation or combinations thereof, and having a specified cost to operate value and a landing fee value. The cost to operate value may be a purchase cost, a lease cost, a permit cost, or the like. (ii) marked action spaces, each designated so as to require a specified action of a player when a piece lands thereon; (iii) marked event spaces, each designated so as to represent an event which may initiate a payment or other event of a player when a piece lands thereon.

The game also includes a random movement means for randomly determining numbers of spaces to be moved by players in accordance with rules. The random movement means is at least one die, which has six major facets, forming a cube, and eight minor facets. Each minor facet is a truncated corner of the cube, wherein the major facets contain indicia for indication of movement of a piece a specified number of spaces. There is a set of operation papers for the marked historical location spaces provided to a player in exchange for payment of play money if a player qualifies to invest and elects to invest in accordance with the rules. There is also a set of event cards corresponding to at least one marked event space to be read and acted upon by a player when a piece lands on a corresponding event space.

The game also has a plurality of different icon pieces for use by a plurality of players. These may be figures, symbols or other flat or stand up pieces, or other icons that may preferably relate to the game theme. There is also play money in predetermined denominations. These two may have symbols, words or other representations that relate to the theme.

The rules define use of the aforesaid by order of play, use of the random movement means, movement of pieces, acquisition of operation papers, sale of operation papers, action space play, event space play, use of event cards, payments of landing fees, and how games may be won or lost.

The board game itself may be a playing board with a shape that is selected from round, square, octagonal and rectangonal, and the marked action spaces are disparate spaces set equally apart from one another.

As one preferred embodiment, the board game is octagonal and the event spaces and the marked action spaces are located at corners of the board.

In some preferred embodiments, the board game event spaces include at least one event space requiring a player to take an event card and act upon it when that player's piece lands upon it. Preferably, there are at least two different event spaces, and two different collections of event cards, and each of the two different event spaces require a player to take and act upon an event card from a specific one of the two different collections of event cards.

The board game may preferably also include draw cards separate from the event cards, and the one or more dice include indicia on the minor facets that represent that a player with a roll landing on the minor facet shall take one of the draw cards.

The board game, in some preferred embodiments, has a plurality of minor unit structures available for purchase to players operating marked historical location spaces wherein other players having a piece land on a marked historical location space with at least one minor structure unit will pay increased landing fees in relationship to the number of minor structures unit on that space landed upon.

Likewise, the board game may preferably have a plurality of major unit structures for purchase or conversion, being equal in value to a specified number of minor unit structures and requiring a greater landing fee for another player landing thereon.

In general, the theme could be based on tourism and be a particular city, place, country or concept. These could be, for example, world famous museums, or castles of Europe, or natural wonders of the world, or famous battle sites. In one preferred embodiment, the game is directed to Egyptian historical sites, namely tombs and structures from the age of the pharohs and pyramids. Thus, the board game, in one preferred embodiment theme is Egyptian pyramids, and related archeology. In this embodiment, the historical location spaces are shown to be Egyptian tombs, and the minor unit structures may be tomb tokens, and the major unit structures may be pyramids. The board game would include a set of operation papers that are individual excavation permit cards corresponding to individual marked board spaces and include historical information relating thereto. The board game landing fees would be tour fees. The board game indicia on the minor facets of the fourteen sided die could be color codes, and the plurality of different icon pieces could represent different three dimensional Egyptian creations, such as pharohs, icons, Egyptian rulers, etc.

In one preferred embodiment, the present invention is an Egyptian pyramids board game, it includes:

(a) an octagonal playing board having a predetermined continuous path with spaces for movement of pieces therealong in accordance with rules, said playing board including:

(i) marked historical Egyptian location spaces designating specified historical locations, said spaces identifying its specified historical Egyptian location by name, pictorial representation or combinations thereof, and having a specified cost to operate value and a landing fee value;

(ii) marked action spaces, each designated with specific instructions so as to require a specified action of a player when a piece lands thereon; and, (iii) marked event spaces, having Egyptian symbols shown thereon, each designated so as to represent an event which may initiate a payment or other event of a player when a piece lands thereon;

(b) a random movement means for randomly determining numbers of spaces to be moved by players in accordance with rules, such as a normal six faceted die or two or more dice, a spinner, novel fourteen faceted dice described above, or any other random outcome device that could indicate moves in accordance with the rules;

(c) a set of operation papers for marked historical Egyptian location spaces provided to a player in exchange for payment of play money if a player qualifies to invest and elects to invest in accordance with rules;

(d) a set of event cards having corresponding Egyptian symbols to at least one marked event space to be read and acted upon by a player when a piece lands on a corresponding event space;

(e) a plurality of different icon pieces for use by a plurality of players;

(f) play money in predetermined denominations; and, (g) rules defining use of the aforesaid by order of play, use of said random movement means, movement of pieces, acquisition of operation papers, sale of operation papers, action space play, event space play, use of event cards, payments of landing fees, and how games may be won or lost.

BRIEF DESCRIPTION OF THE DRAWINGS

The present invention should be more fully understood when the specification herein is taken in conjunction with the drawings appended hereto wherein:

FIG. 1 shows a top view of an Egyptian pyramid theme playing board of the present invention;

FIG. 2 shows a detailed partial oblique view of the present invention playing board shown in FIG. 1, with four minor structural units and one major structural unit used in a present invention game.

FIG. 4 shows a top view of an excavation permit (operating papers) used in one embodiment of the present invention board game;

FIG. 5A shows one embodiment of a special die and FIGS. 5B and 5C show various tokens for until structures that may be used in one embodiment of the present invention board game;

FIG. 6 shows a present invention instruction booklet; and,

FIGS. 7A, B and C illustrate a top oblique view, a side view and an inside view of one embodiment of packaging for a present invention board game.

DETAILED DESCRIPTION OF THE PRESENT INVENTION

Figure 3A:
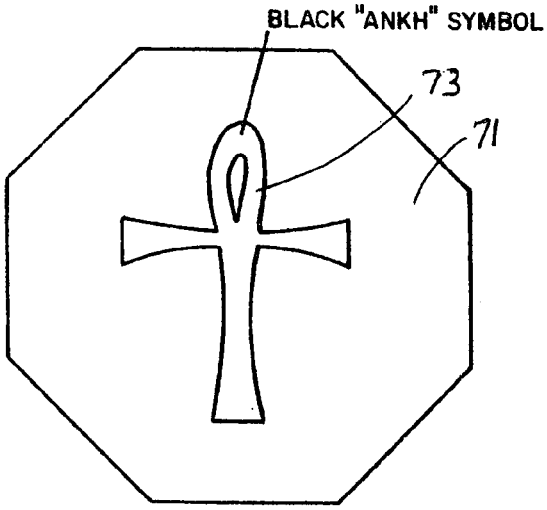
FIGS. 3A, B, C and D show top views of event draw cards and dice draw cards used in one embodiment of the present invention board game.
Figure 3B:
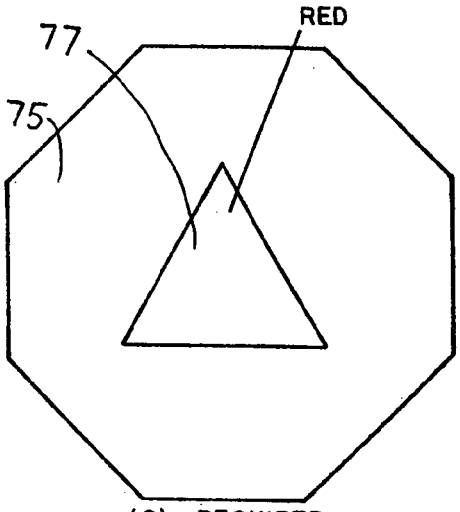
Figure 3C:
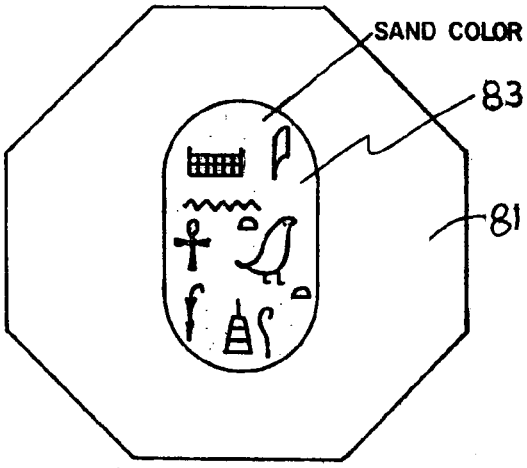
Figure 3D:
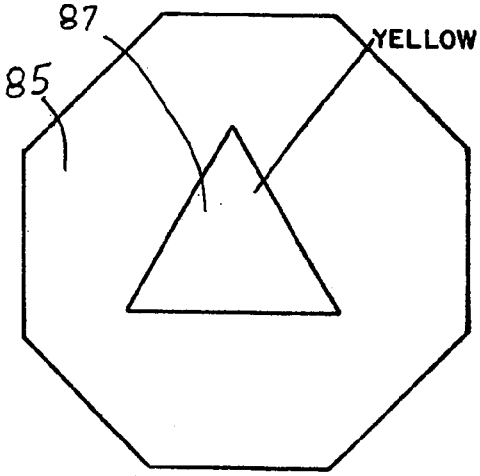

The present invention game board is described in the Summary above in its broadest aspects. The drawings illustrate a single preferred embodiment that is representative of the invention. In the drawings, the Egyptian Pyramids game, called TUTANKHAMUN or KING TUT, is illustrated.

The game of TUTANKHAMUN is a board game that contains specific areas identified as tombs of all of the pharohs from 1569 B.C. thru 1085 B.C. with individual burial chambers specified. Much emphasis is placed on historical accuracy.

There are also special areas and draw cards that give specific directions to players (action to be taken) whose playing pieces land on them.

The game board, all of the components and the instructions are unique, novel and provide an exciting game forum. The game is complex for interest, however not complicated to learn.

The accompanying drawings that include FIGS. 1 through 7 help to graphically explain the TUTANKHAMUN game and its components.

FIG. 1 sets forth game board 1 showing twenty four individual "tomb" sites, special draw card areas and action or movement instruction areas. It may be exceptionally colorful and tend to agree with the art, as well as the blues, yellows, reds, sand and other color tones of the Tut period. In FIG. 1, board 1 has an open center area 3, and an outer octagonal perimeter 5. Around perimeter 5 are octagonal corners, such as corners 7, 9 and 11. These corners contain a starting point 31, event spaces, such as ankh space 33 and 35, and Tut space 37, and also contain event spaces, such as tax space 39 requiring the payment of a tax, and exile space 41. Between each of the corner spaces are marked historical location spaces, in this case, tomb spaces such as spaces 13, 15, 17 and 19. Referring specifically to space 13 (Ramses VIII), there are four squares for minor token placement 21, 23, 25 and 27, and one for a major token (pyramid) placement, square 29. Their use is more fully described below.

Referring now to both FIGS. 1 and FIG. 2, typical "tomb" sites, of which there are twenty four, are grouped in threes, as shown. Each group of three tomb sites is identified with a specific color: tomb of Tutankhamun (shown in FIG. 2 as tomb 51), Rameses IV, Thutmose III, Rameses II, Rameses VI, Amenhotep II, Rameses IX, Thutmose IV, Horemheb, Rameses I, Tawosret, Rameses XI, Merneata III, Smenkhare, Rameses X, Amenhotep IV, Rameses VII, Setnakht, Ay, Rameses V, Rameses VIII, Amenhotep III, Seti I and Rameses III. Each tomb site has five token areas. As shown on the Tut tomb 51, the four minor tokens relate to #(1) entrance, token 53; #(2) Antechamber, token 55; #(3) annex, token 57; and #(4) treasury, token 59. Finally #(5), the burial chamber, corresponds to the major token, pyramid 61. Acquisition of all minor tokens, and other qualifiers, may be prerequisites to attaining a pyramid. This is further explained with respect to the rules, below.

FIGS. 3A, B, C, and D show four different series of special draw cards. In this version of TUT, there are fifteen draw cards 71 with the symbol of ankh 73 (hieroglyphic for life), and fifteen draw cards 81 with symbol of "Tuts" cartouche or signature 83, six cards 75 with the red pyramid symbol 77, and six cards 85 with the yellow pyramid symbol 87. Each card has specific directions/instructions on its back that give the player an asset or a debit or some action of play or chance.

Examples: Receive museum grant of $300., pay power bill $300., pay museum staff $150., receive site overpayment refund $250., move back 8 spaces, receive (1) free entry permit to your tomb color group, receive gov't grant of $200., pay museum repair charges of $500., pay excavators fee $200. etc.

FIG. 4 shows a typical excavation permit 91 in octagonal shape 95. In this version, there are twenty four such documents; to include (8) groups of (3). They are color-keyed, and also otherwise correspond to the "tomb sites" shown in FIGS. 1 and 2. Listed on each permit are charges and other information 93. Included here are the following: tour fee $200. (without any chamber excavations).

1. Tour fee within entrance chamber $850.
2. Tour fee within antechamber $2550.
3. Tour fee within annex chamber $5100.
4. Tour fee within treasury chamber $5400.
5. Tour fee within burial chamber $6000.

Note: Numbers 1 thru 5 correspond to large numbers on tomb sites on playing board, (see FIG. 2)

Concession or sublease value $600.

Entry permit cost—$620.

Entry permit to burial chamber—$670.

Note: Dollar value (cost) for all above is different for each tomb site to maximize competition and enhance play of game.

FIG. 5A shows one of a pair of specially designed (14) sided dice. They may be designed as desired to affect chance on rolling and generally have six major facets, such as facets 103, 105, and 107, and eight minor corner cut facets, such as facets 109, 111, 113, and 115. In this example, the die 101 may be basically black in color with (1) red corner, (7) yellow corners, and white dots (numbers) as indicia to show spaces to be moved, such as indicia 117. The number of special corners is fixed at eight, but the number of each color and the size was developed and planned to rely on a reduced percentage of each corner turning up in any given game and thus also helping to enhance interest and play of game. For this reason, it is preferred that the surface area of the flat corner cuts (minor facets) be less than one half of the surface area of the cubic sides (major facets).

FIGS. 5B and 5C show entrance tokens to "tomb sites". There are two types: a major token 123 pyramid for entrance to burial chamber only, and a "tomb" shaped entrance minor token 121 for entry into all other chambers. Included in this version of the present invention game are approximately thirty (extras included) pyramid shaped type major tokens and approximately seventy five (extras included) "tomb" shaped type minor tokens.

FIG. 6 shows the cover detail of the instruction booklet 125. Featured is the cartouche or "signature" of Tut in hieroglyphics that corresponds to the same symbol 83 of FIG. 3C above.

FIGS. 7A, B and C show oblique, side and opened views, respectively, of one possible package/container 131, especially designed for TUTANKHAMUN game and all components. The box is basically white with art work and coloration to match board game. Box shape is specific, i.e. an irregular hexagon, from a top view 141, not only to conveniently house game board and components, but to provide consumer appeal and allow for unique stacking or arranging within sales displays. The angled sides, such as side 135, will be an eye-catching display on the shelf. Open box 133 includes a group of component storage bins, e.g. bin 151, for small components, such as moving pieces 161 and a left and right side 153 and 157 for card storage, such as cards 155 and 159.

The basic idea of "TUT" is to practice archaeology by purchasing excavation permits from THE BUREAU OF ANTIQUITIES for tomb sites and then purchasing entry permits to excavate the tombs of the PHAROHS . . . thereby contributing to the collections of the museums of the world; while competing to collect TOUR FEES, PRIZES, TREASURES, ETC. AND BECOMING THE WEALTHIEST AND MOST FAMOUS ARCHAEOLGIST (player).

RULES

Starting from ENTRY, move pieces (artifacts) around the octagonal playing board (see FIG. 1) the number of spaces indicated by a throw of special dice (see FIG. 5A). When an archaeologists piece lands on a tomb (see FIG. 2) not already being "EXCAVATED", permission to excavate may be secured from the BUREAU OF ANTIQUITIES by paying the excavation lease amount and securing the excavation permit for the tomb site.

One of the BENEFITS of securing excavation permits (see FIG. 4) and excavating tombs with ENTRY PERMITS is to collect TOUR FEES from opposing archaeologists who land there.

TOUR FEES are enhanced in value by purchasing all excavation permits of a series of tomb sites in the same COLOR GROUP and then purchasing all ENTRY PERMITS into tomb chambers.

Excavation leases can be returned for CONCESSION or SUBLET value to BUREAU OF ANTIQUITIES.

The dice have special RED & YELLOW corners (see FIG. 5A) and when these turn up, a special draw card (see FIGS. 3A, B, C, D) with instructions is followed.

The game of "TUT" is one of excitement, planning, calculation, chance, and because it is HISTORICALLY ACCURATE, it is pleasantly educational.

EQUIPMENT: OCTAGONAL PLAYNG BOARD (see FIG. 1) with the tombs of the PHAROHS of the $18^{th}$, $19^{th}$, and $20^{th}$ dynasties.

There are (4) sets of specialty draw cards which are selected by rolling dice or by landing on an indicated space on the octagonal playing board.

There are (2) dice with special corners, playing pieces, entry chamber tokens, and pyramid tokens. There are EXCAVATION PERMIT CARDS for each tomb and necessary money.

PREPARATION: Place the draw cards face down on the corresponding symbols on the board.

Each individual archaeologist (player) selects a piece to start the game. One player should act as THE BUREAU OF ANTIQUITIES & FINANCIAL REPRESENTATIVE. He is responsible for handling of financial matters, maintains entry permits, concessions, excavation permits, etc.

MONEY: Each player receives a grant of $6,000. As follows: (10) $5. bills, (15) $10. bills, (15) $20. bills, (10) $50. bills, (10) $100. bills (8) $500. Bills.

TO BEGIN THE GAME

Each archaeologist throws dice and the archaeologist with the highest total goes first, second highest goes second, etc.

Place pieces on ENTRY to the valley of the kings. Throw dice and move piece in direction of arrow the number of tombs (spaces) as indicated by dice. Play is always CLOCKWISE. Each space is counted as one.

Depending on the tomb (or space), an archeologist may purchase an excavation permit if not already held, pay tour fee if another player already holds excavation permit or collect or pay or move as directed by special draw cards.

COLLECTING FEES/MONIES: Money can be collected in several ways when moving thru spaces marked "COLLECT GOVERNMENT GRANT OF $500., or as directed by draw cards, and most important and profitable of all, by collection of tour fees.

LANDING ON TOMB SITE NOT BEING EXCAVATED: An archaeologist landing on tomb site NOT already being excavated (leased) has the option of purchasing the excavation permit.

To do this, the archaeologist pays the BUREAU OF ANTIQUITIES the excavation permit price (lease) printed on the tomb site and he then receives excavation permit document TO HOLD.

LANDING ON TOMB SITE ALREADY BEING EXCAVATED: An archeologist landing on tomb site which is already being excavated (leased), must pay holder of tomb site, all monies, charges, TOUR FEES, etc. for HIGHEST position within tomb 1, 2, 3, 4, or burial chamber 5, as indicated on EXCAVATION PERMIT SCHEDULE. In all cases, if a tomb site archaeologist does not request payment of fees before next player throws dice, HE CANNOT COLLECT. * ENTRY INTO VARIOUS CHAMBERS OF TOMB: Before an archeologist can purchase entry permits to enter chambers AS PER SCHEDULE ON EXCAVATION PERMIT, he must have in his possession leases (excavation permits) of ALL TOMBS OF SAME COLOR SERIES, such as, (Tut, Thutmose 3 and Rameses 4). When he elects to purchase an entry permit he is also given a "TOMB" ENTRANCE TOKEN FOR CHAMBERS 1 THRU 4 or a PYRAMID FOR BURIAL CHAMBER 5. (see FIG. 5**B and C)

These tokens are set on tomb site, in proper position to indicate his location within tomb. (see FIG. 2) NOTE: When BURIAL CHAMBER is entered, tokens 1, 2, 3, 4 can be turned in.

Lease holder must purchase his entry permits and install his tomb entry tokens, or pyramid token EQUALLY across his COLOR SERIES of tomb sites. THAT IS: he CANNOT ENTER ALL CHAMBERS OF ONE OF HIS TOMB SITES WITHOUT FIRST SECURING ENTRY PERMITS FOR SAME POSITION WITHIN OTHER TOMBS OF SAME SERIES.

SURPRISE SYMBOL DRAW CARDS: When a player lands on symbol spaces on board or dice (either one or both) lands with YELLOW or RED CORNERS "UP" he draws a corresponding symbol card from proper pile and does EXACTLY as directed. Cards are always returned to pile BOTTOM FACE DOWN. ****

SPECIAL SPACES: When an archaeologist lands on special spaces (NOT SURPRISE SYMBOL CARD SPACES) he must do EXACTLY as directed, collect monies, pay fees, etc.

EXILE: from valley of the kings—When landing on this space, archaeologist must wait there for (3) turns, or if he holds special release card, he may return card to pile and be released immediately from EXILE, IF HE SO DESIRES. During EXILE he CANNOT collect any FEES, MONIES, etc. from opposing players UNTIL HE IS RELEASED.

ENTRY PERMITS: Tomb entry tokens are secured with payment of entry permit cost for 1 ENTRANCE, 2 ANTECHAMBER, 3 ANNEX, and 4 TREASURY.

These pieces are put on tomb site to indicate to other archaeologists the location or position of excavator within tomb site.

BURIAL CHAMBER ENTRY TOKENS: are secured with payment of entry permit cost for 5 BURIAL CHAMBER. NOTE: These entry permits and tokens can be turned back into BUREAU OF ANTIQUITIES for original cost if an archaeologist so desires.

CONCESSION OR SUBLEASE OF A TOMB SITE: If an archeologist so desires, he may turn into the BUREAU OF ANTIQUITIES any one or all of his tomb sites for the CONCESSION VALUE, as indicated on EXCAVATION PERMIT CARD SCHEDULE. This card is then held separately by the BUREAU OF ANTIQUITIES and they can be purchased (for concession value) by another player when it is his turn.

When an archaeologist reaches a point where he can no longer afford to purchase tomb sites, excavate, or pay his fees, even after returning his tombs, permits for CONCESSION VALUE, he is considered OUT OF THE ARCHAEOLOGY PROFESSION and must leave the game.

Whatever minor assets he leaves, must be returned to the BUREAU OF ANTIQUITIES.

THE LAST ARCHAEOLOGIST IN THE GAME IS CONSIDERD THE WINNER

Obviously, numerous modifications and variations of the present invention are possible in light of the above teachings. It is therefore understood that within the scope of the appended claims, the invention may be practiced otherwise than as specifically described herein.

What is claimed is:

1. An Egyptian pyramids theme board game, which consists of:

(a) a playing board having a predetermined continuous path with spaces for movement of pieces therealong in accordance with rules, being octagonal in shape, said playing board including:

(i) marked historical location spaces designating specified historical locations based on said Egyptian pyramids theme, said spaces identifying its specified historical location by name, pictorial representation or combinations thereof, and having a specified cost to operate value and a landing fee value;

(ii) marked action spaces, each designated so as to require a specified action of a player when a piece lands thereon; and, (iii) marked event spaces, each designated so as to represent an event which may initiate a payment or other event of a player when a piece lands thereon;

(b) a random movement means for randomly determining numbers of spaces to be moved by players in accordance with rules, said random movement means being at least one die, said at least one die having six major facets, forming a cube, and eight minor facets, each minor facet being a truncated corner of said cube, wherein said major facets contain indicia for indication of movement of a piece for specified number of spaces;

(c) a set of operation papers for marked historical location spaces provided to a player in exchange for payment of play money if a player qualifies to invest and elects to invest in accordance with rules;

(d) a set of event cards corresponding to at least one marked event space to be read and acted upon by a player when a piece lands on a corresponding event space;

(e) a plurality of different icon pieces for use by a plurality of players;

(f) play money in predetermined denominations;

(g) rules defining use of the aforesaid by order of play, use of said random movement means, movement of said pieces, acquisition of said operation papers, sale of said operation papers, action space play, event space play, use of said event cards, payments of landing fees, and how the games may be won or lost; and, (h) a plurality of minor unit structures available for purchase to players owning marked historical location spaces wherein other players having a piece land on a marked historical location space with at least one of said plurality of minor unit structures will pay increased landing fees in relationship to the number of said plurality of minor structure on that space;

wherein said game further includes draw cards separate from said event cards, and said at least one die includes indicia on said minor facets that represent that a player with a roll landing on said minor facet shall take one of said draw cards.

2. The board game of claim 1 wherein said marked action spaces are disparate spaces set equally apart from one another.

3. The board game of claim 2 wherein said event spaces and said marked action spaces are located at corners of said board.

4. The board game of claim 1 wherein said event spaces include at least one event space requiring a player to take an event card and act upon it when that player's piece lands upon it.

5. The board game of claim 1 wherein there are at least two different event spaces, and two different collections of event cards, and each of said at least two different event spaces require a player to take and act upon an event card from a specific one of said at least two different collections of event cards.

6. The board game of claim 1 wherein said board game further includes a plurality of major unit structures for purchase or conversion, being equal in value to a specified number of minor unit structures and requiring a greater landing fee for another player landing thereon.

7. The board game of claim 1 wherein said historical location spaces are shown to be Egyptian tombs, said minor unit structures are tomb tokens, and said major unit structures are pyramids.

8. The board game of claim 1 wherein said set of operation papers are individual excavation permit cards corresponding to individual marked board spaces and include historical information relating thereto.

9. The board game of claim 1 wherein said landing fees are tour fees.

10. The board game of claim 1 wherein said indicia on said minor facets are color codes.

11. The board game of claim 1 wherein said plurality of different icon pieces represent different three dimensional Egyptian creations.

12. The board game of claim 1 wherein said historical location spaces are marked historical Egyptian location spaces designating specified historical locations, said spaces identifying its specified historical Egyptian location by name, pictorial representation or combinations thereof.

* * * * *